US006685353B2

(12) United States Patent
Arroyo

(10) Patent No.: US 6,685,353 B2
(45) Date of Patent: Feb. 3, 2004

(54) DICE CLOCK WITH FLASHING LIGHT SHOW FOR GAMBLING

(76) Inventor: Vincent Arroyo, 621 S. Susan, Santa Ana, CA (US) 92704

( * ) Notice: Subject to any disclaimer, the term of this patent is extended or adjusted under 35 U.S.C. 154(b) by 0 days.

(21) Appl. No.: 10/170,048

(22) Filed: Jun. 11, 2002

(65) Prior Publication Data

US 2003/0227828 A1 Dec. 11, 2003

(51) Int. Cl.[7] ..... G04B 37/00

(52) U.S. Cl. ..... 368/276; 368/223; 368/227; 368/280; 368/285; D10/1

(58) Field of Search ..... 368/10, 3, 276, 368/280, 285, 223, 227; 273/146; D10/40, 1, 2, 21, 24

(56) References Cited

U.S. PATENT DOCUMENTS

| | | | | |
|---|---|---|---|---|
| D80,934 | S | | 4/1930 | Bachman |
| D83,573 | S | | 3/1931 | Schisgall |
| D92,278 | S | | 5/1934 | Weiss |
| D102,150 | S | | 12/1936 | Stein et al. |
| D109,517 | S | | 5/1938 | Krueger |
| 2,243,343 | A | * | 5/1941 | Johnson ..... 368/223 |
| D202,630 | S | | 10/1965 | Hurley |
| D204,894 | S | | 5/1966 | Hurley |
| 3,357,703 | A | | 12/1967 | Hurley |
| 4,188,779 | A | | 2/1980 | Fatton |
| D282,913 | S | | 3/1986 | Stevens |
| 4,858,209 | A | * | 8/1989 | Chaut ..... 368/223 |
| D341,543 | S | | 11/1993 | Michelotti et al. |
| D370,285 | S | | 5/1996 | Widdup |

* cited by examiner

*Primary Examiner*—David Martin
*Assistant Examiner*—Jeanne-Marguerite Goodwin
(74) *Attorney, Agent, or Firm*—Gene Scott-Patent Law & Venture Group

(57) ABSTRACT

A clock apparatus comprises a clock case made of either an opaque material or a translucent material, the clock case enclosing an electronic circuit comprising electronic circuit elements including: a clock timer, a source of electrical current, a power switch, a switching device, and a means for illumination. The clock case comprises a pair of cubes, with an upper one of the cubes mounted at one corner, on a face of a lower one of the cubes. The cubes provide apertures having a distribution on the clock case in correspondence with the dots of a pair of dice. Windows made of either an opaque or a translucent material, cover the apertures so that light from the illumination means of the electrical circuit is visible through either the clock case or the windows as a light show in accordance with the switching device. A clock face is engaged with the clock timer and is mounted on one of the faces of the upper one of the cubes so as to be visible to a viewer of the light show.

2 Claims, 3 Drawing Sheets

DICE CLOCK WITH FLASHING LIGHT SHOW FOR GAMBLING

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to clocks and electronic light shows and more particularly to an operating clock face mounted on one face of a simulated pair of dice which are positioned as if in the midst of rolling on a craps table and wherein the dice are electronically enabled for producing an electronic light show.

2. Description of Related Art

The following art defines the present state of this field:

Bachman, U.S. Pat. No. Des. 80,934 describes a lamp design

Schisgall, U.S. Pat. No. Des. 83,573 describes a dial for a timepiece design.

Weiss, U.S. Pat. No. Des. 92,278 describes a lamp design.

Stein et al., U.S. Pat. No. Des. 102,150 describes a watchbase design.

Krueger, U.S. Pat. No. Des. 109,517 describes a combination lamp and game device design.

Hurley, U.S. Pat. No. Des. 202,630 describes game display panel design.

Hurley, U.S. Pat. No. Des. 204,894 describes a clock design.

Stevens, U.S. Pat. No. Des. 282,913 describes a wrist watch design.

Michelotti, U.S. Pat. No. Des. 341, 543 describes a wrist watch design.

Widdup, U.S. Pat. No. Des. 370,285 describes a lamp with clock radio design.

Hurley, U.S. Pat. No. 3,357,703 describes a combination clock and amusement apparatus comprising display means disposed for view by the players and presenting a pair of generally square outlines to represent the faces of two dice; a plurality of separately energizable electroluminescent members forming a part of said display means and being positioned so that selected areas within each of said outlines can be illuminated to represent the dots in their positions as they normally appear on the various faces of a die; player operated means actuatable by said players; first control means responsive to an actuation of said player operated means to energize selected ones of said electroluminescent members and thereby illuminate a randomly selected number of said areas within each of said outlines; timer means; and second control means connected to said timer means and said electroluminescent members, said second control means being operative, when the system is not being controlled by means of said player operated means, to energize selected ones of said electroluminescent members so that the total number of said areas which are illuminated is equal to the hour of the day.

Fatton, U.S. Pat. No. 4,188,779 describes an electronic timepiece with a device for indicating the time, which is electronically controlled and is used to display elements which simulate a game of chance. Additional circuits are provided for the control of the display of the elements of the game and at least part of the circuits of the timepiece, normally intended for the measure of the time are used in order to perform the choice at random of the elements.

The prior art teaches simulated dice mounted one on top of the other as a lamp base; dice pairs showing time quantitatively; a dice cube illuminated as a lamp; a dice cage mounted on a dice base; and various dice designs for games and other devices. The present invention teaches that a pair of cubes representing dice may be joined in such manner as to indicate dice in motion when thrown, and may present a working clock face to indicate that time is a critical variable in a gambling process. Further such a pair of cubes may have internal illumination as a light show to illustrate that the dots of the dice are moving and eventually come to a halt to show winners and losers. Such an apparatus may, itself, be programmed to randomly illuminate the dots coming to a halt at a pair of randomly illuminated dice faces thereby indicating winners or losers. The present invention fulfills these needs and provides further related advantages as described in the following summary.

SUMMARY OF THE INVENTION

The present invention teaches certain benefits in construction and use which give rise to the objectives described below.

A clock apparatus comprises a clock case made of either an opaque material or a translucent material, the clock case enclosing an electronic circuit comprising electronic circuit elements including: a clock timer, a source of electrical current, a simple on-off power switch, a switching device adapted for programmed switching, and a means for illumination. The clock case comprises a pair of cubes, with an upper one of the cubes mounted at one corner on a face of a lower one of the cubes. The cubes provide apertures having a distribution on the clock case in correspondence with the dots of a pair of dice. Windows made of either an opaque or a translucent material, cover the apertures so that light from the illumination means of the electrical circuit is visible through either the clock case or the windows as a light show in accordance with the switching device. A clock face is engaged with the clock timer and is mounted on one of the faces of the upper one of the cubes so as to be visible to a viewer of the light show.

A primary objective of the present invention is to provide an apparatus and method of use of such apparatus that provides advantages not taught by the prior art.

Another objective is to provide such an invention capable of appearing to be a pair of tumbling dice.

A further objective is to provide such an invention capable of keeping and telling accurate time.

A still further objective is to provide such an invention capable of providing a light show.

A yet still further objective is to provide such an invention capable of providing a light show to which one may gamble.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
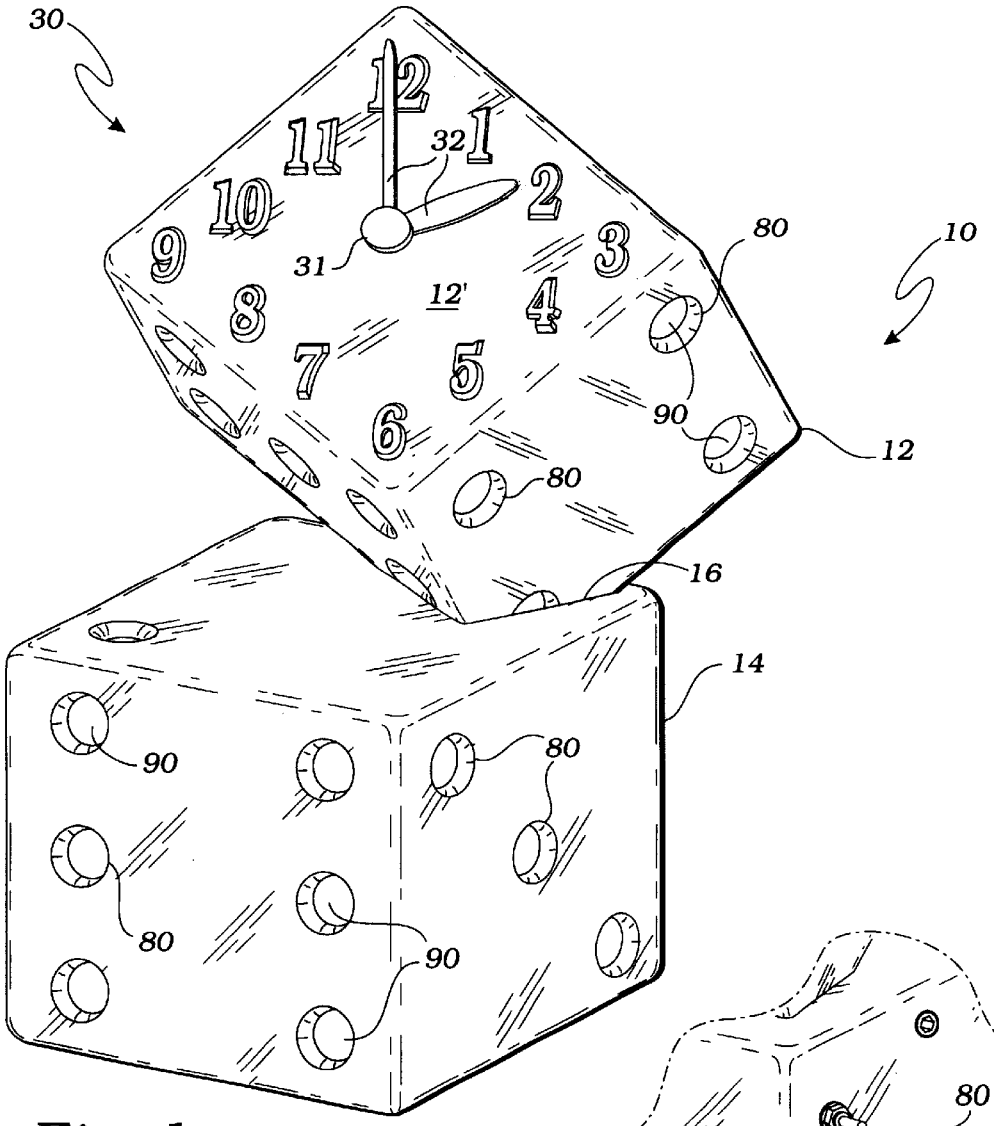
FIG. 1 is a perspective view of the preferred embodiment of the invention.
Figure 3:
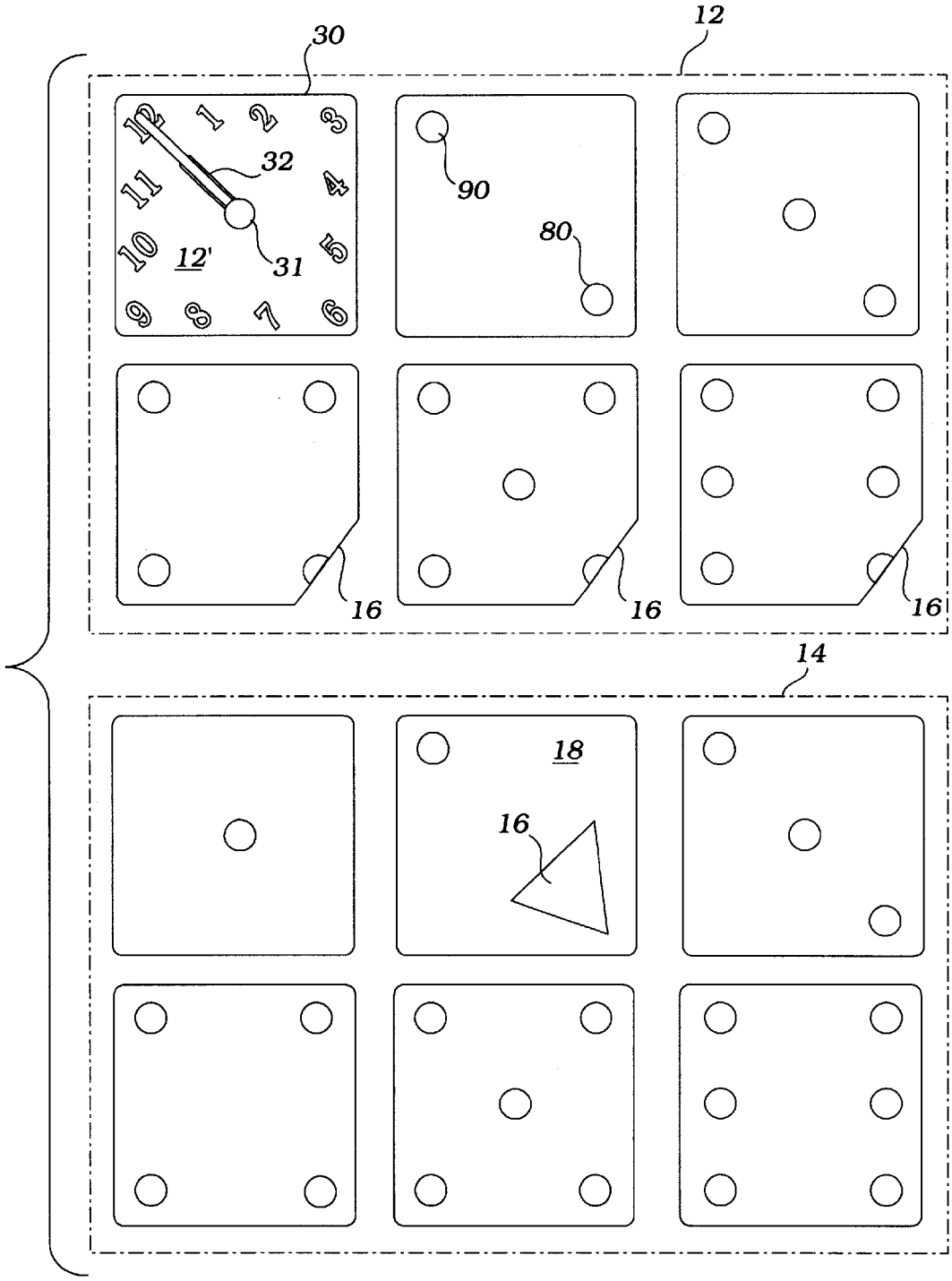
FIG. 3 is a graphical representation of the faces of a case thereof.

A clock apparatus comprises, as shown in FIG. 1, a clock case 10 made of either an opaque material or a translucent material such as a plastic sheet or plate. The clock case 10 comprises a pair of hollow cubes 12, 14, with an upper one of the cubes 12 mounted at one corner 16 thereof onto a face 18 of a lower one of the cubes 14. The lower one of the cubes 14 forms a base for the upper one of the cubes 12 and they are preferably joined by any common fastener means as would be known in the art. The cubes 12, 14 provide apertures 80 into the interiors of the cubes 12, 14 and these apertures 80 have a distribution on the clock case 10 in correspondence with the dots of a standard pair of dice, so that the cubes 12, 14 fully resemble a pair of dice, which is in the process of rolling during a gambling or similar process. A clock face 30 is engaged with a clock mechanism 35 within the clock case 10, with the face 30 mounted externally on one of the faces of the upper one of the cubes 12, as is shown in FIGS. 1 and 3. As shown in FIG. 3, the clock face 30 is mounted specifically on the one-dot face of the upper one of the cubes 12. This is significant in that the center of rotation 31 of a pair of clock hands 32 of the clock face 30 is positioned where the one-dot would be on the one-dot face 12' of the upper one of the cubes 12 and is constructed, in appearance, to resemble the aperture 80. The apertures on the faces of the cubes are positioned and oriented such that, from any direction of viewing, the sum of the apertures 80, of each pair of visible cube faces, is numerically 7, a lucky number in the gambling industry.

Figure 2:
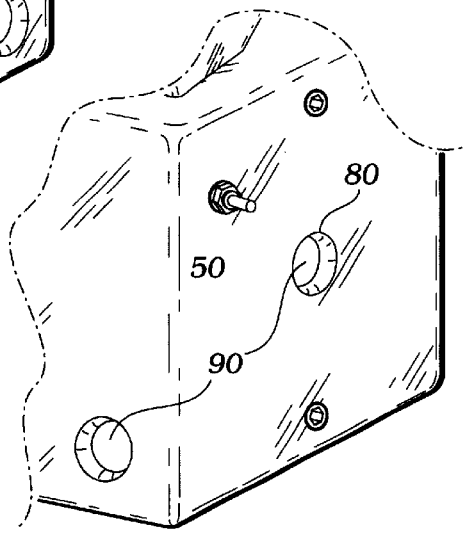
FIG. 2 is a partial perspective view thereof showing a control.
Figure 5:
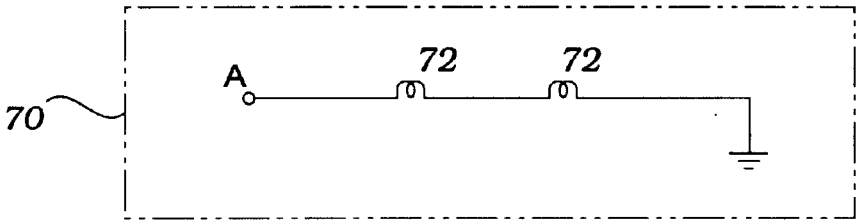
FIG. 5 is a schematic diagram of a first embodiment of the illumination means of the invention.
Figure 6:
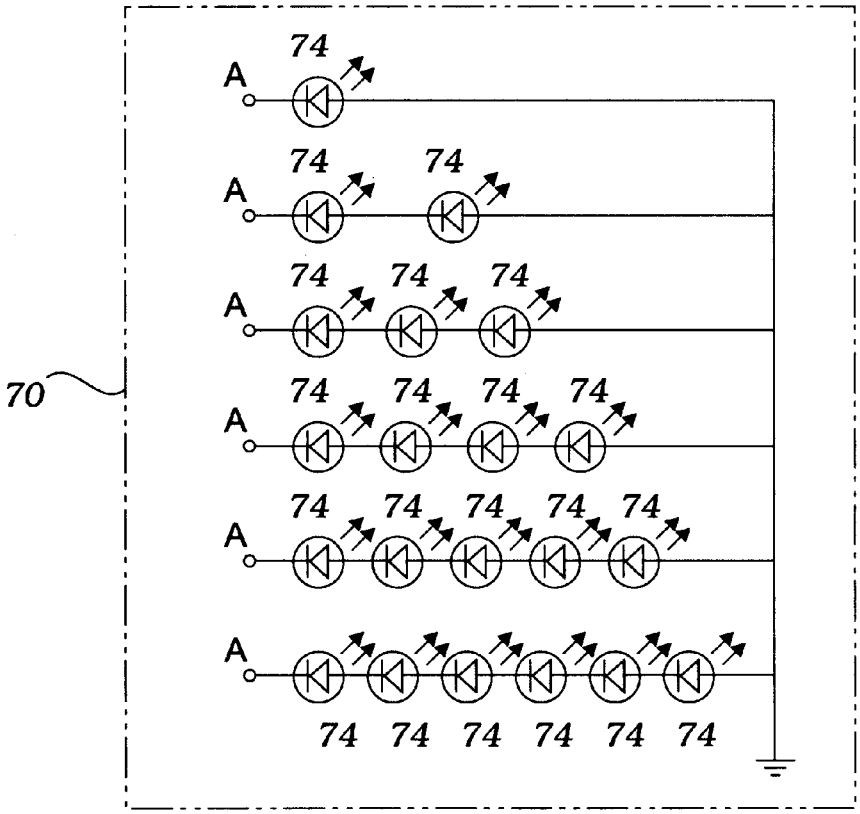
FIG. 6 is a schematic diagram of a second embodiment of the illumination means of the invention.

The clock case 10 encloses an electronic circuit 20 of any conventional type and this circuit 20 is preferably located in the lower one of the cubes 14. The circuit 20 includes electronic circuit elements such as the clock timer 33, a source of electrical current 40, a power switch 50, a switching device 60, and a means for illumination 70. The clock timer 33 may be any such device and is well known in the art. The current source 40 may be external power drawn from current mains and delivered to the apparatus by an electrical cord, or it may be a battery located within the case 10. The switch 50 may be a push-button type, as shown in FIG. 2, or other common switching element well known in the art. The switching device 60 may be of any common type such as is known in Christmas tree ornament sequencing, theatre marquee light sequencing, and such. The means for illumination 70 is preferably single incandescent lamps 72 located within each of the cubes, as illustrated in FIG. 5, or alternately it may be an LED 74 located directly behind each of the apertures 80, as shown in FIG. 6 for one of the cubes 12, 14, the other being identical. In such an embodiment, the several windows may be illuminated separately as desired in producing a more complex light show and will support the use of the cubes for gambling, as described below. The illumination means 70, may alternately be any type of lighting device.

Windows 90 are made of either the opaque or translucent materials mentioned earlier, and are engaged with the clock case 10 by an adhesive or equivalent fastener, in positions for covering the apertures 80. Light from the illumination means is therefore visible through either the clock case, if it is translucent, or the apertures if they are translucent, or both, as a light show in accordance with the switching device 60. The light show is particularly dramatic when the case 10 is opaque and the windows 90 are translucent, or when the case 10 is translucent and the windows 90 are opaque.

FIG. 3 shows the various faces of the cubes laid-out, with the six faces of the upper one of the cubes 12 shown above six faces of the lower one of the cubes 14. It should be noted that the four-dot, five-dot and six-dot faces of the upper one of the cubes 12 have only a partial aperture 80 as this portion of the upper one of the cubes 12 forms a mounting base for the upper one of the cubes 12. It should be also noted that the two-dot face of the lower one of the cubes 14 has a triangular area where the mounting base of the upper one of the cubes 12 rests upon and engages it.

Figure 4:
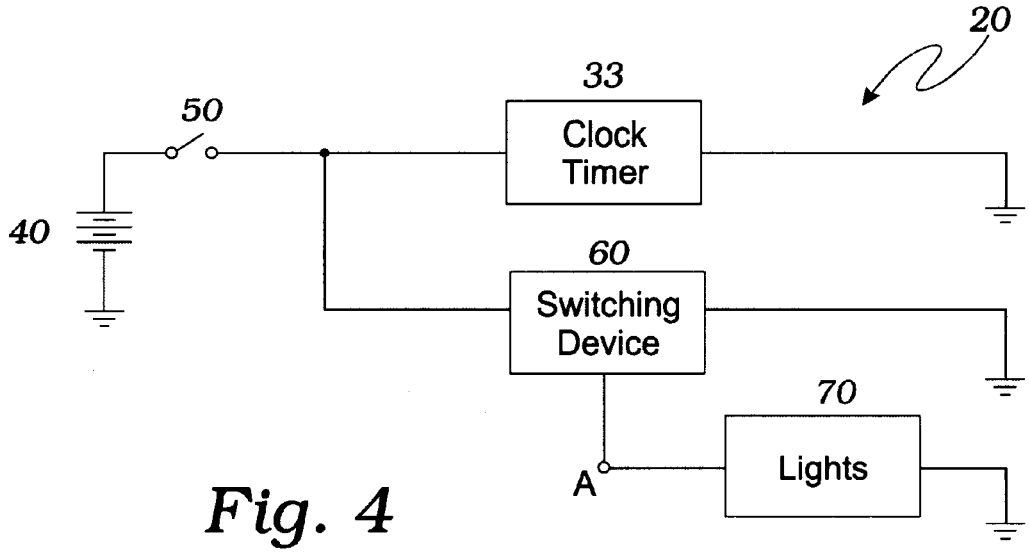
FIG. 4 is a schematic diagram of an electronic circuit thereof.

The switching device 60 may be adapted to illuminate the two cubes 12, 14 through lamps 72, as shown in FIG. 5, in alternating sequence or in unison. To accomplish this the circuits of FIGS. 4 and 5 are used. The switching device 60 may be also adapted, as is well known, to adjust the current output to lamps 72 so that the light show may be adapted to change the magnitude of the illumination with time, again, sequentially or in unison. Alternately, the circuit of FIG. 6 may be used wherein the various windows 90 may be illuminated in a selected sequence. The circuit of FIG. 6 enables the windows of each face of the cubes 12, 14 to be illuminated separately from each other. It would be obvious to one of skill to modify circuit 6 to enable the illumination of each window separately as well.

The switching device 60 preferably is programmed to illuminate the windows in each of the faces of the cubes in a random order a selected period of time such as for 30 seconds, eventually slowing the rate of illumination of the windows of each of the selected faces and stopping on a randomly selected pair of faces of the respective cubes to indicate results of a simulated dice toss to those playing a craps game with the present invention. One of skill in the programming art would be able to prepare a program to accomplish this task and to incorporate such a program into the switching means. It should be noted that when none of the faces of the cubes appears to be illuminated, then the resultant is snake-eyes, because the one-dot face of the lower one of the cubes 14 is facing downwardly so as not to be visible, and the one-dot face of the upper one of the cubes 12 has the clock face so that it is not illuminated.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A clock apparatus comprising: a clock case made of one of an opaque material and a translucent material, the clock case enclosing an electronic circuit comprising electronic circuit elements including: a clock timer, a source of electrical current, a power switch, a switching device, and a means for illumination; the clock case comprising a pair of cubes, with an upper one of the cubes mounted at one corner thereof on a upwardly facing face of a lower one of the cubes, the cubes providing apertures having a distribution on the clock case in correspondence with the dots of a pair of dice; windows made of one of the opaque and the translucent material, engaged with the clock case and positioned for covering the apertures; light from the illumination means being visible through at least one of the cubes and the windows as a light show in accordance with a program of the switching device, and a clock face engaged with the clock timer, the clock face mounted on one of the faces of the cubes.

2. The clock apparatus of claim 1 wherein the switching device incorporates a program for randomly sequencing the illumination of pairs of the respective windows on faces of the pair of cubes wherein such illumination sequencing moves at an initial high rate of change followed by a slowing rate of change to stop at a randomly selected illuminated pair of the windows on the faces of the pair of cubes to indicate results of a simulated dice toss.

* * * * *